United States Patent [19]

Perry et al.

[11] 4,002,390

[45] Jan. 11, 1977

[54] ARRANGEMENT FOR AND METHOD OF PREVENTING RELATIVE ROTATION OF ELECTRIC TERMINALS DURING A TIGHTENING OPERATION

[75] Inventors: William H. Perry, Atlanta; William G. Morgan, III, Lilburn, both of Ga.

[73] Assignee: Kearney-National Inc., Atlanta, Ga.

[22] Filed: Oct. 28, 1975

[21] Appl. No.: 626,216

[52] U.S. Cl. ..... 339/95 R; 339/263 R

[51] Int. Cl.[2] ..... H01R 9/10

[58] Field of Search ..... 339/95, 244, 249, 263, 339/231, 232, 277; 151/41.73, 68

[56] References Cited

UNITED STATES PATENTS

| | | | |
|---|---|---|---|
| 1,048,574 | 12/1912 | Newbold | 339/263 R |
| 1,732,261 | 10/1929 | Crews | 339/232 |
| 2,654,078 | 9/1953 | Arthur | 339/263 R |
| 3,259,161 | 7/1966 | Rosan | 151/41.73 |

FOREIGN PATENTS OR APPLICATIONS

| | | | |
|---|---|---|---|
| 1,051,931 | 3/1959 | Germany | 339/263 R |
| 609,144 | 9/1948 | United Kingdom | 339/263 R |

*Primary Examiner*—Joseph H. McGlynn
*Attorney, Agent, or Firm*—Walter M. Rodgers; Walter A. Rodgers

[57] ABSTRACT

An arrangement for preventing relative rotation of electric terminals during a tightening operation comprises an electric conductor terminal having an electric contact surface through which an aperture extends and an associated terminal having a cooperating contact surface from which an integral stud protrudes, said stud being disposed within said aperture and having an associated fastening nut threadedly related with said stud for holding said contact surfaces in face contacting relation and said stud and said aperture being related by specially configured complementary portions for preventing relative rotation therebetween.

7 Claims, 5 Drawing Figures

ARRANGEMENT FOR AND METHOD OF PREVENTING RELATIVE ROTATION OF ELECTRIC TERMINALS DURING A TIGHTENING OPERATION

In order to provide a secure electric connection between two terminals and to prevent damage resulting from arcing, substantial pressure must be applied to the terminals. Contact pressure is ordinarily applied by a nut threaded onto a bolt disposed within apertures formed in the two terminals. As the amount of tightening pressure is increased, the terminal in contact with the nut tends to rotate in the direction that the nut is turned due to friction therebetween. It is thus apparent that an electric short circuit might occur due to contact of the rotated terminal with another adjacent electric component.

According to this invention, means are provided for preventing relative rotation of electric terminals during a tightening operation and comprises an electric conductor terminal having an electric contact surface and an aperture therethrough, a cooperating electric terminal having a contact surface and an integral stud protruding therefrom and means cooperating with the stud for securing together the contact surfaces of the terminals, the aperture being specially configured to cooperate with a complementary part of the stud in such manner as to preclude relative rotation therebetween.

For a more detailed description of this invention, reference may be had to the following description taken in conjunction with the accompanying drawings in which:

FIG. 4 is a top plan view of the other modified terminal which corresponds to the terminal shown in FIG. 3; and in which

Figure 1:
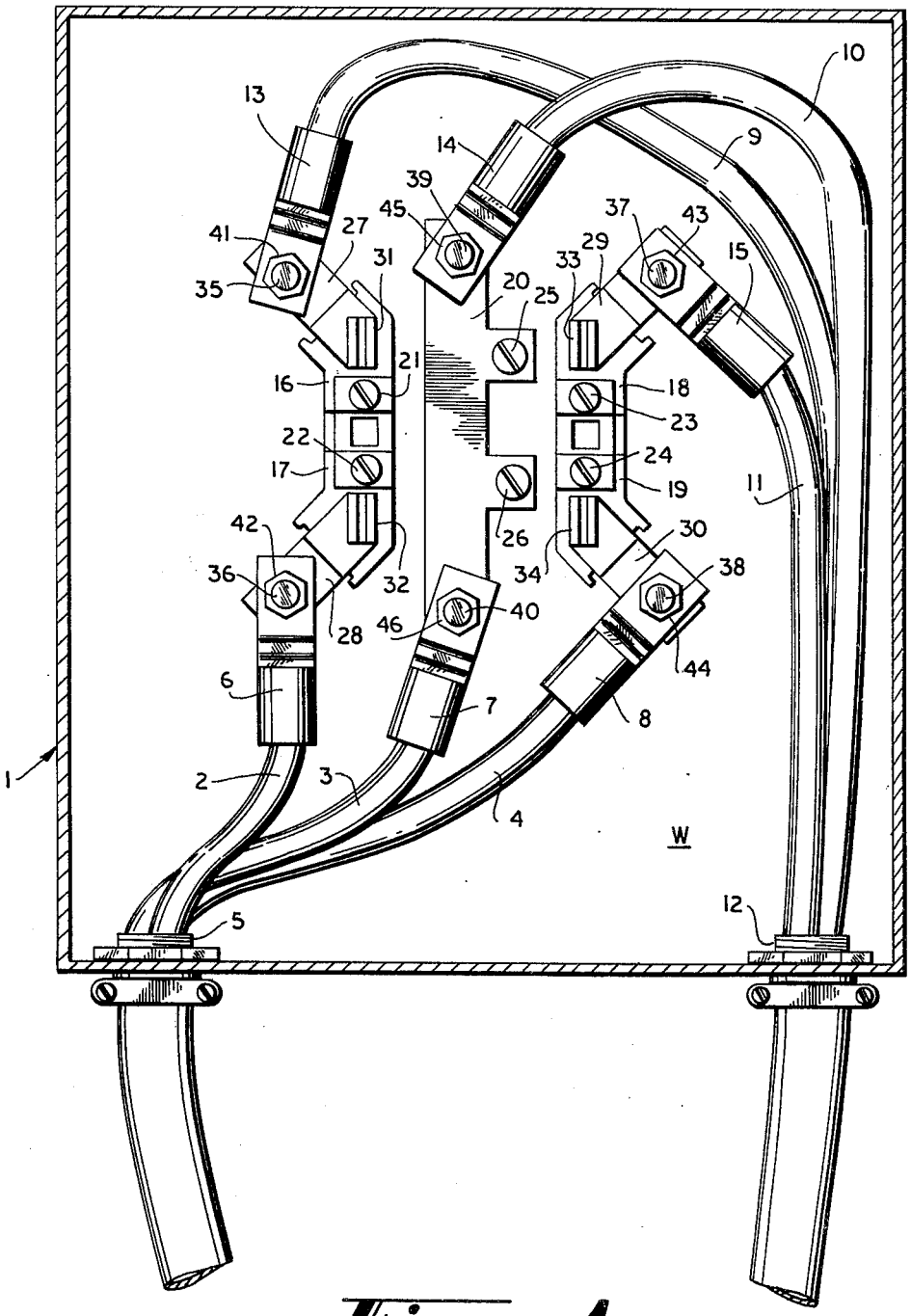
FIG. 1 depicts a meter terminal box with the front cover thereof and the meter removed.

In FIG. 1 the numeral 1 generally designates a terminal box having electric conductors 2, 3 and 4 which enter terminal meter box 1 through aperture 5. Electric conductors 2, 3 and 4 are respectively provided with terminals 6, 7 and 8. In like manner electric conductors 9, 10 and 11 extend through aperture 12 in box 1. Electric conductors 9, 10 and 11 are connected respectively with terminals 13, 14 and 15.

Base plates 16, 17, 18 and 19 are formed of insulating material and are respectively mounted by screws 21, 22, 23 and 24 to back wall W of terminal box 1. Likewise conducting plate 20 is secured to wall W of box 1 by means of screws 25 and 26 and constitutes a ground connection for conductors 3 and 10.

Terminals 27, 28, 29 and 30 are respectively mounted on base plates 16, 17, 18 and 19 and are integral with meter engaging terminal elements 31, 32, 33 and 34. At the ends of terminals 27, 28, 29 and 30 remote from the meter engaging terminal elements, integral studs 35, 36, 37 and 38 are respectively disposed. In like manner, at opposite ends of conducting plate 20 are disposed studs 39 and 40. Apertured terminals 6, 8, 13 and 15 are secured in electric contact with terminals 28, 30, 27 and 29 respectively via threaded studs 36, 38, 35 and 37 by means of nuts 42, 44, 41 and 43 respectively.

Terminals 7 and 14 are secured in contact with opposite ends of conducting plate 20 via threaded studs 40 and 39 respectively and their associated nuts 46 and 45.

Figure 2:
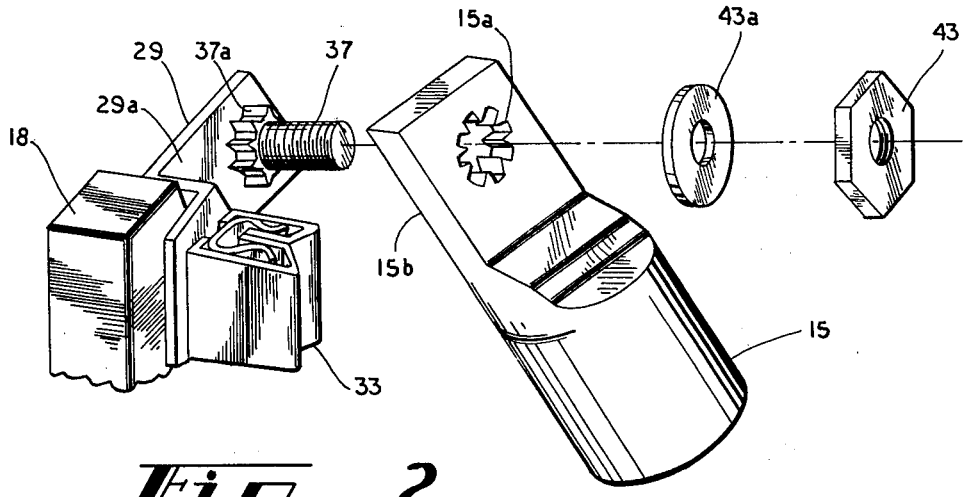
FIG. 2 is an enlarged exploded view of a terminal connection of the type shown in FIG. 1 and which is constructed according to this invention.

FIG. 2 depicts an enlarged view of terminals 15 and 29 formed according to this invention and embodies the same elements as any of the terminal connections shown in FIG. 1. The terminal connection shown in FIG. 2 includes meter terminal element 33, terminal 29, base plate 18, nut 43, washer 43*a*, conductor terminal 15, and terminal stud 37 which is integral with terminal 29 according to one aspect of this invention.

More specifically electric conductor terminal 15 is provided with a serrated aperture 15*a*. Terminal stud 37 is provided with a serrated base portion 37*a* which is adapted to cooperate with serrated aperture 15*a*. The electric contact surface 29*a* of electric terminal 29 is adapted to engage the corresponding contact surface 15*b* of terminal 15 in face contacting relation to form an electric connection therebetween.

It is apparent from FIG. 2 that contact surfaces 29*a* and 15*b* are held in face contacting relationship by fastening means in the form of nut 43 and washer 43*a* in cooperation with stud 37 while serrated aperture 15*a* receives serrated base portion 37*a* of stud 37. Thus when nut 43 and washer 43*a* are tightened on the threaded portion of stud 37, a secure electric contact is accomplished between contact surfaces 29*a* and 15*b* while at the same time relative rotation between terminals 29 and 15 is prevented.

In order to provide a secure and firm connection between contact surfaces 29*a* and 15*b*, the thickness of the end of terminal 15 should be at least equal to or greater than the thickness of serrated base portion 37*a* of terminal stud 37. By this means nut 43 and its associated washer 43*a* are always in snug tight fitting contact with the portion of terminal 15 adjacent aperture 15*a* and tightening of a nut such as 43 does not rotate the terminal such as 15 relative to terminal 29 and into contact with an adjacent terminal such as 14 or 8. The base portion 37*a* of stud 37 is of a greater transverse dimension than the diameter of the threaded portion of the stud.

While the aperture 15*a* and complementary base portion 37*a* of stud 37 are shown in FIG. 2 as being serrated, other configurations may be employed within the scope of this invention. For example, the aperture 15*a* and base 37*a* could be of complementary square, rectangular, elliptical, trapezoidal or other irregular non-circular configuration so long as relative rotation of the terminals such as 15 and 29 is prevented.

Figure 3:
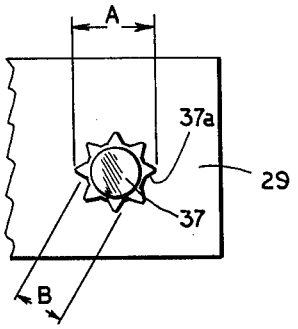
FIG. 3 is a top plan view of one terminal constructed according to a modification of the invention.
Figure 4:
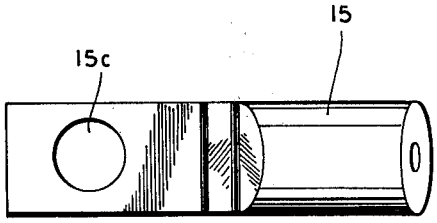
Figure 5:
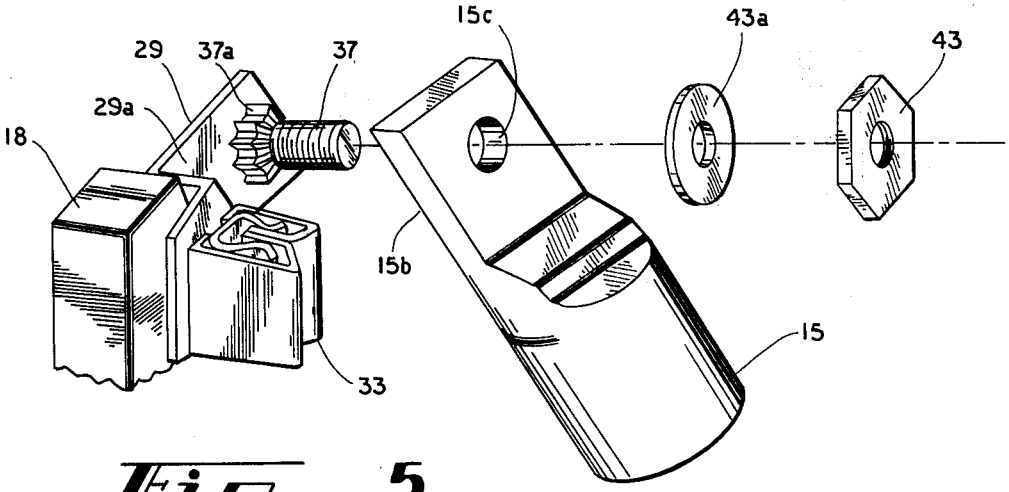
FIG. 5 is an exploded view of the modified terminal connection.

FIGS. 3, 4 and 5 depict an alternate arrangement for preventing relative rotation between terminals 15 and 29. The major structural difference between the arrangement shown in FIG. 2 and that disclosed in FIGS. 3, 4 and 5 is that deformable aperture 15*c* of terminal 15 is not serrated. Specifically the diameter of deformable aperture 15*c* is less than distance A shown in FIG. 3 which is the diameter of serrated base portion 37*a*. In addition the diameter of deformable aperture 15*c* must be greater than distance B shown in FIG. 3 which is the diameter of terminal stud 37. Therefore when the proper angular alignment of terminals 15 and 29 is determined, fastening means in the form of nut 43 and washer 43*a* is tightened onto threaded terminal stud 37. As the tightening operation progresses, serrated base portion 37*a* cuts into and deforms aperture 15*c*. Therefore by this method relative rotation between terminals 15 and 29 is prevented thus achieving the same result as the arrangement shown in FIG. 2. In order to aid in the proper positioning of deformable aperture 15*c* around serrated base portion 37*a*, the bottom portion of deformable aperture 15*c* and the top portion of serrated base portion 37*a* is bevelled. This insures that deformable aperture 15*c* is properly aligned on serrated base portion 37*a* prior to the tightening operation.

As viewed in FIGS. 3, 4 and 5, it would be obvious to provide aperture 15*c* with a serrated periphery and to provide base portion 37*a* with a deformable surface. The terminal connection is formed in the same manner as described above thus preventing relative movement between terminals 15 and 29.

The embodiments of the invention in which an exclusive property or privilege is claimed are defined as follows:

1. An arrangement for preventing relative rotation between cooperating electric terminals having flat face contacting contact surfaces and for securing said contact surfaces together, said arrangement comprising a threaded stud integral with one terminal and arranged to protrude from the contact surface thereof and disposed within a circular aperture formed in the other terminal, the contact surface of the other terminal being disposed generally normal to the axis of said stud, said stud having an enlarged circular base portion on the periphery of which serrations are formed and said aperture having complementary serrations formed in the circular walls thereof and selectively engageable with the serrations in said base portion to prevent relative rotation between said terminals in planes parallel to said contact surfaces, and fastening means threadedly related with said stud for securing said contact surfaces together.

2. An arrangement according to claim 1 wherein said serrations of said stud are disposed at the base of said stud and wherein the other terminal is of greater thickness than said serrations of said stud in a direction normal to the contact surfaces of said terminals.

3. An arrangement for preventing relative rotation between cooperating electric terminals having flat face contacting contact surfaces and for securing said contact surfaces together, said arrangement comprising a stud having an enlarged base portion and a threaded end portion and being integral with one terminal and arranged to protrude substantially perpendicularly from the contact surface thereof and an aperture formed in the other terminal and extending therethrough and with its axis in substantially perpendicular relation to the contact surface thereof, the terminals being arranged with their contact surfaces in flat face contacting relation to each other and with said base portion of said stud disposed within said aperture, the periphery of said base portion of said stud and the cooperating part of said aperture being of irregular complementary configurations whereby relative rotation of the terminals in planes parallel to said contact surfaces is prevented, and fastening means threadedly related with the threaded end of said stud for securing said contact surfaces together in firm current transferring contact with each other.

4. An arrangement according to claim 3 wherein said irregular complementary configurations comprise serrations.

5. An arrangement according to claim 3 wherein said other terminal is of greater thickness than the base portion of said stud in a direction normal to said contact surfaces.

6. An arrangement according to claim 3 wherein said aperture and said base portion of said stud are circular and wherein the diameter of said aperture is greater than the diameter of said threaded portion of said stud and less than the diameter of said base portion.

7. A method of forming an electric connection between a pair of electric terminals each having a flat contact surface and wherein a stud with an enlarged base protrudes from the contact surface of one terminal and wherein an aperture is formed in the other terminal with its axis in normal relation to the contact surface thereof the method comprising the steps of inserting said stud within said aperture, moving the terminals toward each other in a direction normal to said contact surfaces, securing said terminals against relative rotation by causing said enlarged base of said stud to deform said aperture, and finally securing said contact surfaces in firm current carrying contact with each other.

* * * * *